US011639844B2

(12) United States Patent
Pavier

(10) Patent No.: US 11,639,844 B2
(45) Date of Patent: May 2, 2023

(54) PENETRATING AND EXPLOSIVE PROJECTILE WITH STABILIZING FIN ASSEMBLY

(71) Applicant: NEXTER MUNITIONS, Versailles (FR)

(72) Inventor: Julien Pavier, Bourges (FR)

(73) Assignee: NEXTER MUNITIONS, Versailles (FR)

( * ) Notice: Subject to any disclaimer, the term of this patent is extended or adjusted under 35 U.S.C. 154(b) by 0 days.

(21) Appl. No.: 17/500,471

(22) Filed: Oct. 13, 2021

(65) Prior Publication Data

US 2022/0214149 A1 Jul. 7, 2022

(30) Foreign Application Priority Data

Oct. 19, 2020 (FR) ..... 2010626

(51) Int. Cl.
*F42B 10/06* (2006.01)
*F42C 1/10* (2006.01)

(52) U.S. Cl.
CPC ..... *F42B 10/06* (2013.01); *F42C 1/10* (2013.01)

(58) Field of Classification Search
CPC ..... F42B 10/06; F42B 10/02; F42B 10/04; F42B 10/14; F42B 10/16; F42B 10/18; F42B 10/64; F42B 10/62; F42C 1/02; F42C 1/04; F42C 1/06; F42C 1/08; F42C 1/09; F42C 1/10; F42C 1/12
USPC ..... 102/251
See application file for complete search history.

(56) References Cited

U.S. PATENT DOCUMENTS 3,687,398 A * 8/1972 Beuschel ..... F41J 9/10 102/498
3,788,230 A * 1/1974 Losfeld ..... F42B 12/20 102/373
4,671,179 A * 6/1987 Synofzik ..... F42C 19/0826 102/431
4,730,561 A * 3/1988 Schaake ..... F42B 10/06 102/521
4,863,428 A * 9/1989 Chevalier ..... F42B 12/54 102/512

(Continued)

FOREIGN PATENT DOCUMENTS

AU 2008238615 A1 * 11/2009 ..... A62C 3/025
CA 2683005 A1 * 10/2008 ..... A62C 3/025

(Continued)

OTHER PUBLICATIONS

Jun. 17, 2021 Search Report and Written Opinion issued in French Patent Application No. 2010626.

*Primary Examiner* — John Cooper
(74) *Attorney, Agent, or Firm* — Oliff PLC

(57) ABSTRACT

The invention relates to a penetrating and explosive projectile (1) provided with a trajectory-stabilizing fin assembly (8) which is secured to a body of the projectile by a mechanical connection. The fin assembly (8) includes a tapped tube (14) which engages on a threaded rear cylindrical shank (10) of a tail (9) connected to the projectile body (2), thereby forming a threaded mechanical connection (13) between the tail unit (8) and the body (2). This projectile (1) is characterized in that it includes means ensuring the fragilization of the threaded connection (13) on impact on a target, the fin assembly then separating from the projectile body.

5 Claims, 2 Drawing Sheets

(56) References Cited

U.S. PATENT DOCUMENTS 4,995,573 A * 2/1991 Wallow ..... F42B 10/06 102/521
5,014,931 A * 5/1991 Mikhail ..... F42B 10/06 244/3.25
5,088,416 A * 2/1992 Sabranski ..... F42B 12/06 102/521
5,097,766 A * 3/1992 Campoli ..... F42B 10/06 102/513
5,107,766 A * 4/1992 Schliesske ..... F42B 12/16 102/373
5,112,008 A * 5/1992 Pahnke ..... F42B 10/06 244/3.24
5,158,509 A * 10/1992 Ebaugh ..... F42B 10/06 264/273
5,388,523 A * 2/1995 Rossmann ..... F42B 14/067 102/521
5,798,479 A * 8/1998 Bonamy ..... F42B 10/06 102/517
6,109,185 A * 8/2000 Mikhail ..... F42B 12/16 102/293
6,540,176 B2 * 4/2003 Davis ..... F42B 10/48 244/3.25
7,150,235 B1 * 12/2006 Mikhail ..... F42B 10/06 102/521
7,581,501 B1 * 9/2009 Boone ..... F42B 12/365 102/501
8,887,641 B1 * 11/2014 Manole ..... F42B 14/06 102/521
9,470,491 B1 * 10/2016 Ginetto ..... F42B 10/14
10,352,668 B1 * 7/2019 Hooke ..... F42B 12/74
2002/0088897 A1 * 7/2002 Davis ..... F42B 10/06 244/3.24
2004/0055502 A1 * 3/2004 Hunn ..... F42B 10/08 102/519
2010/0237186 A1 * 9/2010 Fu ..... F42B 10/42 244/3.25
2012/0048991 A1 * 3/2012 Frey, Jr. ..... F41G 7/2246 89/1.14

FOREIGN PATENT DOCUMENTS

DE 30 38 087 A1 5/1982
DE 39 33 442 A1 4/1991
DE 198 35 175 B3 12/2005
DE 19948710 B4 * 3/2006 ..... F42B 10/06
EP 690283 A1 * 1/1996 ..... F42B 10/06
GB 2241307 A * 8/1991 ..... F42B 12/06
GB 2283182 A * 5/1995 ..... F42B 6/003
WO WO-2011112668 A1 * 9/2011 ..... F41G 7/2246

* cited by examiner

PENETRATING AND EXPLOSIVE PROJECTILE WITH STABILIZING FIN ASSEMBLY

The technical field of the invention is that of fin assembly-stabilized projectiles, and more particularly that of explosive and penetrating projectiles.

Explosive projectiles that also have penetrating capability are intended to penetrate armored protection and explode behind the protection.

To achieve this, the body of the projectile has a reinforced warhead and the fuze ensuring the firing of the explosive charge is located at a rear part (or base) of the projectile so as not to be destroyed by the impact.

However, the fin assembly of the projectiles always forms a mass that remains behind the fuze and may disrupt the operation of the fuze on impact.

The aim of the invention is therefore to propose a penetrating and explosive projectile with an architecture that does not disturb or destroy the fuze on impact on a target.

The invention thus relates to a penetrating and explosive projectile provided with a trajectory-stabilizing fin assembly which is secured to a body of the projectile by a mechanical connection, the fin assembly including a tapped tube which engages on a threaded rear cylindrical shank of a tail connected to the projectile body, thereby forming a threaded mechanical connection between the fin assembly and the body, the projectile being characterized in that it includes means ensuring the fragilization of the threaded connection on impact on a target, the fin assembly then separating from the projectile body.

In a particular embodiment, the projectile has a fuze arranged at a rear part of the projectile and the tail carrying the fin assembly includes a conical portion which connects to the body of the projectile.

The fin assembly may also include fragilization means consisting of breakage initiators arranged on the tube of the tail, between the fins of the consisting of, wherein said breakage initiators are made as longitudinal grooves that ensure a thinning of the thickness of the tube, the inertial advance motion of the fin assembly on the conical portion, upon impact of the projectile on a target, causing the grooves to break.

Each fin may include a conical front part cooperating with the conical portion of the tail.

The front part of the tube may also include a conical part in continuation of the conical front parts of the fins.

The invention will be better understood upon reading the following description of various embodiments, description made with reference to the annexed drawings in which.

Figure 1:
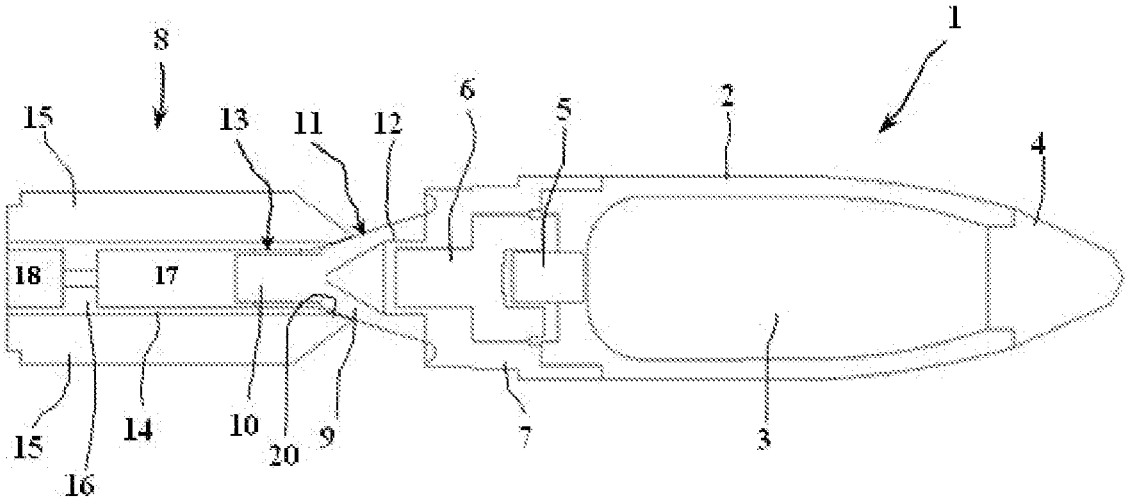
FIG. 1 shows a schematic longitudinal section of an embodiment of a projectile according to the invention.

Referring to FIG. 1, a projectile 1 according to an embodiment of the invention includes a body 2 enclosing an explosive charge 3. The body 2 is closed at its front part by a tip 4 made of dense material, such as a steel with high mechanical characteristics or a tungsten alloy, and which is intended to enable penetration of a target.

The explosive charge 3 is intended to be initiated by a detonation relay 5 which is itself initiated by a fuze 6 which is arranged in a base 7 secured to the rear part of the body 2, for example by a thread.

The projectile 1 also includes a stabilizing fin assembly 8 which is secured to the body 2 of the projectile by means of a threaded mechanical connection that includes a tail 9. This tail 9 includes a rear cylindrical shank 10, extended at the front by a conical portion 11 which connects to the body 2 of the projectile at a threaded bearing surface 12 of the base 7.

The cylindrical shank 10 includes a thread on which is screwed a tapped tube 14 that carries the fins 15 of the fin assembly 8. The thread of the shank 10 and the tapped hole of the tube 14 form the threaded connection 13.

As can be seen in FIG. 1, the tube 14 carries an internal partition 16 which separates a front chamber 17 and a rear chamber 18. The rear chamber 18 is intended to receive a pyrotechnic tracer.

According to the invention, the projectile 1 includes means ensuring the fragilization of the threaded connection 13 between the thread of the shank 10 and the tapped hole of the tube 14 upon impact of the projectile on a target.

Thus, the inertial forces exerted on the fin assembly 8 at the impact will cause the fragilization means to break, thus ensuring the separation of the fin assembly 8 and the body 2 of the projectile 1.

For example, a simple transverse groove on the shank 10, between the threaded part and the conical portion 11, could be defined as fragilization means.

This groove will weaken the shank 10 which will break upon impact on a target.

The fin assembly 8 will then detach from the projectile 1 and will not interfere with the operation of the fuze.

It should be noted that the external profile of the conical portion 11 also ensures a deflection of the fin assembly 8, thus protecting the fuze 6 against the impacts caused by the latter.

It can be seen in FIG. 1 that the tail 9 has a conical portion 11.

Therefore, if the fins 15 or the fin assembly 8 hit the projectile body 2, the impact will occur at a distance from the fuze 6 and will not disrupt the operation of the fuze.

Figure 2:
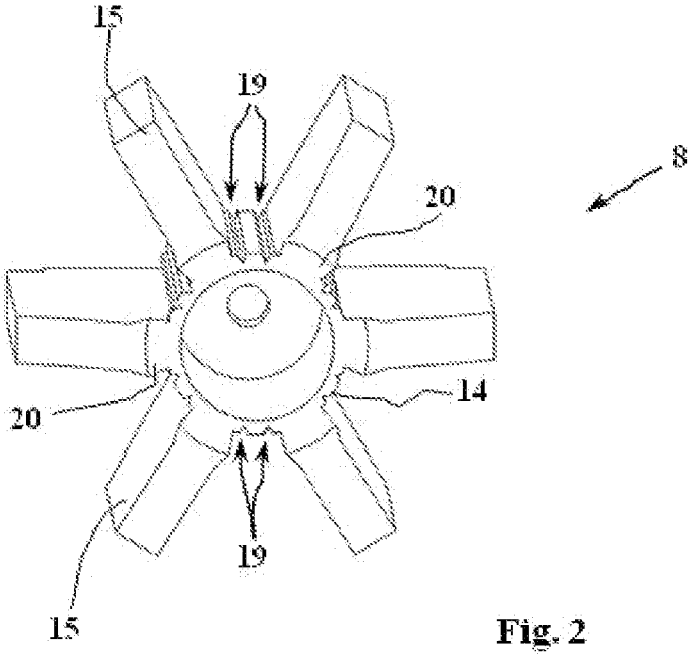
FIG. 2 shows the fin assembly alone in perspective.

In a particular embodiment of the invention, it is noted in FIG. 2 that the fin assembly 8 includes longitudinal grooves 19 which extend longitudinally along substantially the entire length of the tube 14 and which are arranged between each pair of fins 15 of the fin assembly, midway between two adjacent fins 15. Here, there are two parallel longitudinal grooves 19 arranged between each pair of fins 15.

These grooves 19 ensure a thinning of the thickness of the tube 14 and constitute breakage initiators for the wall of the tube 14. It is also noted that each fin 15 includes a front part with conical profile 20 which is intended to cooperate with the conical portion 11 of the tail 9. This front part with conical profile 20 also extends at the front part of the tube 14 which is also conical.

Figure 3:
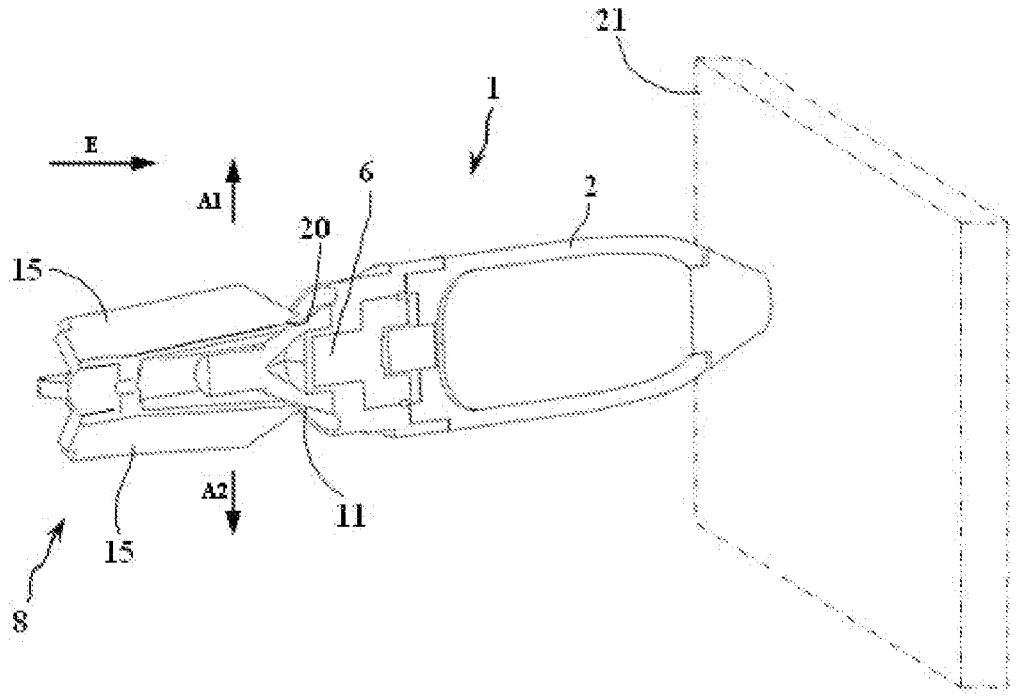
FIG. 3 shows the deformation of the fin assembly upon impact on a target.

As can be seen in FIG. 3, upon impact of the projectile 1 on a target 21, the projectile 1 is strongly decelerated. The decelerated 8 advances, due to inertia (arrow E), towards the conical portion 11, causing the threaded connection 13 to be sheared off.

This advance motion of the fin assembly 8 leads to a sliding of the conical part 20 of each fin 15 (and of the tube 14) on the profile of the conical portion 11 of the tail 9. This results in a radial stress leading to an enlargement of the internal diameter of the tube 14. This stress causes the grooves 19 to break and the fins 15 to move away from each other (arrows A1 and A2).

Each fin 15 thus follows a trajectory that moves it away from the fuze 6.

Such an arrangement makes the breakage of the threaded connection 13 more reliable and ensures that the impacts that the fin assembly 8 could cause on the fuze 6 are reduced to a minimum.

The invention claimed is:

1. A penetrating and explosive projectile comprising:

a projectile body;

a tail that includes a conical portion that is connected to the projectile body and a threaded cylindrical shank located to a rear of the conical portion;

a trajectory-stabilizing fin assembly that is secured to the projectile body by a mechanical connection, the fin assembly including a tapped tube which engages on the threaded cylindrical shank of the tail, wherein the mechanical connection is a threaded mechanical connection between the fin assembly and the projectile body; and means ensuring fragilization of the threaded mechanical connection on impact on a target so that the fin assembly separates from the projectile body, wherein:

the conical portion is tapered toward the threaded cylindrical shank and is positioned relative to the fin assembly such that, when the fin assembly advances due to inertia towards the conical portion upon impact of the projectile, the threaded mechanical connection is sheared off because of an enlargement of an internal diameter of the tapped tube.

2. The penetrating and explosive projectile according to claim 1, wherein a fuze is arranged at a rear part of the projectile body.

3. The penetrating and explosive projectile according to claim 2, wherein:

the means ensuring fragilization includes breakage initiators arranged on the tapped tube between fins of the fin assembly, said breakage initiators are longitudinal grooves that are configured to create a thinning of a thickness of the tapped tube, and an inertial advance motion of the fin assembly on the conical portion causes the grooves to break upon impact of the projectile.

4. The penetrating and explosive projectile according to claim 3, wherein each fin includes a conical front part cooperating with the conical portion of the tail.

5. The penetrating and explosive projectile according to claim 3, wherein a front part of the tapped tube also includes a second conical part in continuation of conical front parts of the fins.

* * * * *